US007159692B1

(12) United States Patent
Frederiksen et al.

(10) Patent No.: US 7,159,692 B1
(45) Date of Patent: Jan. 9, 2007

(54) SILENCER

(75) Inventors: Svend Frederiksen, Holte (DK); Lars Frederiksen, Gentofte (DK); Soren Aerendal Mikkelsen, Frederiksberg (DK)

(73) Assignee: Silentor Holding A/S, Hedehusene (DK)

( * ) Notice: Subject to any disclaimer, the term of this patent is extended or adjusted under 35 U.S.C. 154(b) by 849 days.

(21) Appl. No.: 10/110,319

(22) PCT Filed: Oct. 11, 2000

(86) PCT No.: PCT/DK00/00576

§ 371 (c)(1),
(2), (4) Date: Jul. 11, 2002

(87) PCT Pub. No.: WO01/27445

PCT Pub. Date: Apr. 19, 2001

(30) Foreign Application Priority Data

Oct. 11, 1999 (DK) ..... 1999 01452
Apr. 6, 2000 (DK) ..... 2000 00588

(51) Int. Cl.
*F01N 1/08* (2006.01)
*F01N 1/02* (2006.01)
*F01N 7/08* (2006.01)

(52) U.S. Cl. ..... 181/249; 181/255; 181/227; 181/228

(58) Field of Classification Search ..... 181/249, 181/251, 255, 227, 228, 257, 268, 269, 275, 181/267
See application file for complete search history.

(56) References Cited

U.S. PATENT DOCUMENTS 452,020 A * 5/1891 Prince, Jr. ..... 181/268
593,970 A * 11/1897 Schwarm ..... 181/269
1,070,600 A * 8/1913 Haugen ..... 181/268
1,532,928 A * 4/1925 O'Connor ..... 181/275
1,685,701 A * 9/1928 Blanchard ..... 181/268
2,122,086 A * 6/1938 Chase ..... 181/269

(Continued)

FOREIGN PATENT DOCUMENTS

CH 308988 8/1955

(Continued)

*Primary Examiner*—Edgardo San Martin
(74) *Attorney, Agent, or Firm*—Birch, Stewart, Kolasch & Birch, LLP

(57) ABSTRACT

A silencer that comprises a casing, one or more pipes or passages leading a flow of gas to the casing and a device for leading gas from the casing. The silencer further has at least one internal chamber, one or more flow inlets to the chamber and one or more flow outlets from the chamber, and one or more flow distributing devices connected to the flow inlet(s) and/or to the flow outlet(s). The flow distributing device comprises one or more walls or profiles extending on a geometrical surface that defines a boundary between an inner volume of the flow distributing device and the chamber. The silencer further has one or more apertures for a flow of gas through the apertures and for leading gas either out of the inner volume into the chamber, or into the inner volume from the chamber. The apertures have a smallest cross-sectional transverse dimension s and a length L, the dimension s being at the maximum 0.2 times the smallest cross-sectional dimension D of the inlet or outlet. The length L is at least the same as the dimension s.

41 Claims, 5 Drawing Sheets

U.S. PATENT DOCUMENTS

| | | | | | |
|---|---|---|---|---|---|
| 2,512,155 | A | * | 6/1950 | Hill | 181/249 |
| 2,544,284 | A | * | 3/1951 | Stephens et al. | 181/251 |
| 2,706,014 | A | * | 4/1955 | Carroll | 181/239 |
| 2,716,463 | A | * | 8/1955 | Latulippe | 181/267 |
| 2,720,935 | A | * | 10/1955 | Lysholm et al. | 181/257 |
| 3,335,813 | A | * | 8/1967 | Kelley | 181/247 |
| 3,396,535 | A | * | 8/1968 | Milos | 60/307 |
| 3,957,133 | A | * | 5/1976 | Johnson | 181/256 |
| 3,999,624 | A | * | 12/1976 | Treftc et al. | 181/269 |
| 4,638,838 | A | * | 1/1987 | Richard et al. | 138/30 |
| 4,685,533 | A | * | 8/1987 | Piesik | 181/213 |
| 4,685,534 | A | * | 8/1987 | Burstein et al. | 181/251 |
| 5,371,331 | A | * | 12/1994 | Wall | 181/227 |
| 5,659,158 | A | | 8/1997 | Browning et al. | |
| 5,758,497 | A | * | 6/1998 | Frederiksen et al. | 60/299 |
| 6,283,246 | B1 | * | 9/2001 | Nishikawa | 181/255 |
| 6,341,663 | B1 | * | 1/2002 | Alex et al. | 181/249 |

FOREIGN PATENT DOCUMENTS

| | | | |
|---|---|---|---|
| FR | 807 035 | | 12/1936 |
| FR | 2 622 632 | | 5/1989 |
| GB | 481 172 | | 5/1936 |
| WO | WO 9927237 | A1 * | 6/1999 |

* cited by examiner

SILENCER

This application is the national phase under 35 U.S.C. § 371 of PCT International Application No. PCT/DK00/00579 which has an International filing date of Oct. 11, 2000, which designated the United States of America.

TECHNICAL FIELD

The present invention relates to a silencer, such as a silencer for attenuating the sound level in exhaust gases emerging from a combustion engine.

BACKGROUND OF THE INVENTION

Perforated pipes are commonly used in combustion engine exhaust silencers to provide distribution of flow to or from internal silencer chambers and/or to provide acoustic resistance to gas flow through the perforations contributing to overall noise attenuation. Such perforations are normally made as simple holes and create pressure energy losses affecting engine performance adversely.

DESCRIPTION OF THE INVENTION

The aim of the present invention is to design silencer flow elements which may replace simple perforated pipe elements in silencers retaining or even improving the beneficial flow distribution and acoustic resistance effects, but with smaller pressure energy losses, preferably with no or only slightly increased cost of manufacture and with no or only minor increase of silencer weight.

According to the invention, by replacing simple holes with apertures of some length and of flow-friendly geometry the objects of the invention may be fulfilled in advantageous ways. In some embodiments of the invention, these apertures of some length are shaped as small diffusers.

The silencer according to the invention incorporates flow distributing means. When such flow distributing means are incorporated in a prior art silencer, they may result in lower pressure-drop across the silencer. At the same time, the silencing performance of the silencer may be substantially retained or even improved.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
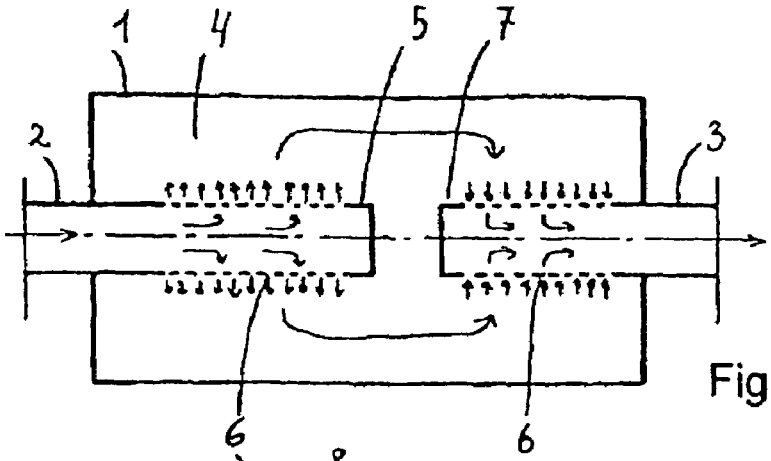
Fig. 1 Prior Art
FIGS. 1 and 1*a* show a prior art silencer in which simple perforated pipes are used.
Figure 1A:
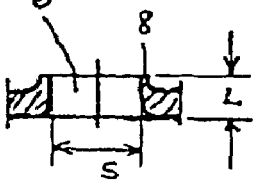
Fig. 1a Prior Art

FIG. 1 is an illustration of a conventional prior art silencer in which simple perforated pipes are used. The silencer comprises a casing 1, an inlet pipe 2, an outlet pipe 3, a chamber 4, a perforated pipe 5 connected to the inlet pipe and with perforations 6, and a perforated pipe 7 connected to the outlet pipe 3. FIG. 1*a* is an enlarged cross-sectional view of a perforation 6. These perforations are typically made in a punching process creating a small deformation ring 8 around each perforation.

Figure 2:
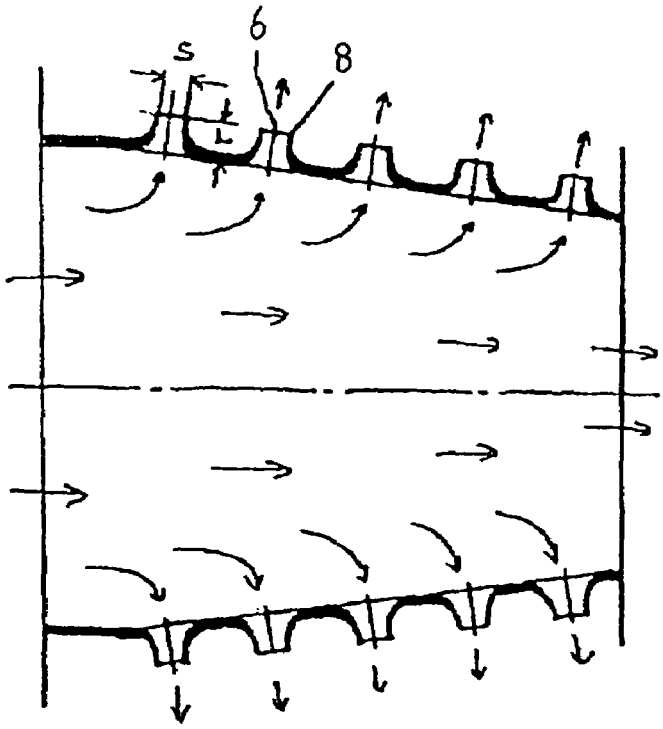
FIG. 2 shows a first embodiment of the invention.

FIG. 2 shows part of a first embodiment of the invention. Here, the length L of each perforation is bigger than in FIG. 1. This has been achieved by adding radial compression forces in the punching process, assisting plastic material flow and avoiding plastic rupture of the deformation ring 8. The length L in flow direction through each perforation is bigger than the smallest transverse dimension s of the perforation. This adds acoustic resistance. The perforation geometry in FIG. 2 is more flow-friendly than the one shown in FIG. 1*a*. Also, in FIG. 2 the general cross-sectional area of the pipe diminishes in the flow direction, which assists even flow distribution through the various perforations.

It is clear that when creating perforations by punching there is a limit as to how long (in the flow direction) perforations can be made, if one is not to increase plate thickness. In silencers for vehicles, permissible plate thickness will often be restricted for both cost and weight reasons. Apertures of a substantial length L in the flow direction can be created by fitting each perforation with a small pipe, but this has to be done in a rational manner for manufacture not to be too time consuming.

Figure 3:
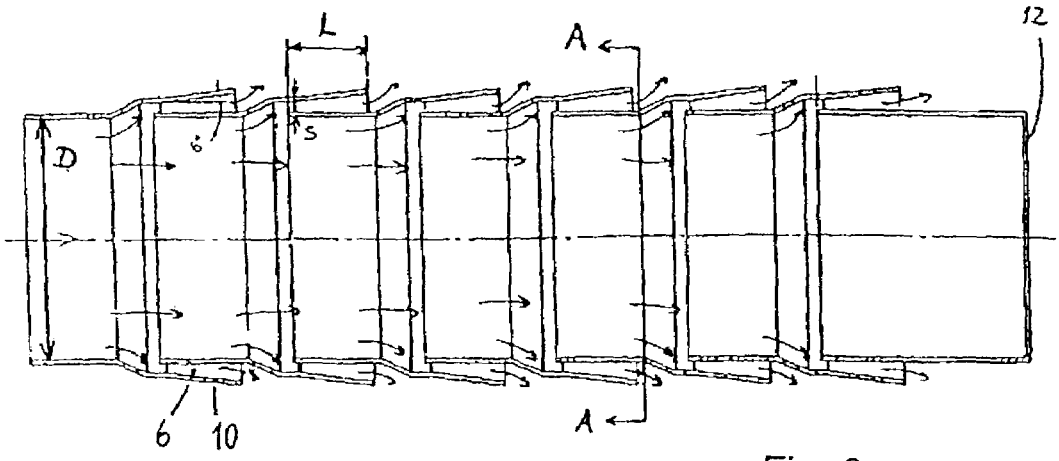
FIGS. 3 and 3*a* show a second embodiment of the invention.
Figure 3A:
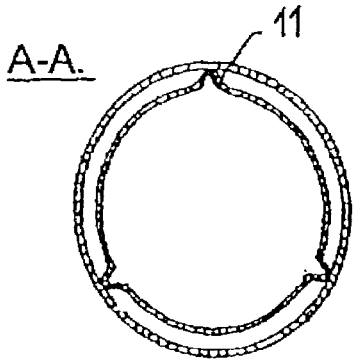

In the second embodiment of the invention shown in FIG. 3, these difficulties have been overcome in a manufacture-friendly way. Here, perforations have been replaced by a series of slots 6 extending between a succession of identical pressed pipe members 10 of rotational symmetrical form. As the cross-sectional FIG. 3*a* shows, these members are provided with ribs 11 (positioned at 120 degrees round the periphery) to fix the members together in a press operation and/or by welding. As can further be seen, the members are pressed to such a form that slots 6 have widening cross-sectional areas in the flow direction, i.e. they are all small diffusers providing pressure recovery. With this technique of apertures being axial slots instead of radial perforations as in FIG. 2, it has become possible to create flow-friendly apertures with a length L which is several times the size s of the smallest transverse dimension.

The flow distributing pipe made up by the rotational symmetric members is terminated by a transverse solid wall 12. Alternatively, if axial outflow from the end of the pipe is preferred, for instance because this can assist a preferred flow distribution within the chamber, the terminating wall can be made with simple perforations or with diffuser-formed apertures. Further possible variations are to simply omit the wall or to terminate with an axial diffuser or with a "splitter" diffuser of a well-known type.

Figure 4:
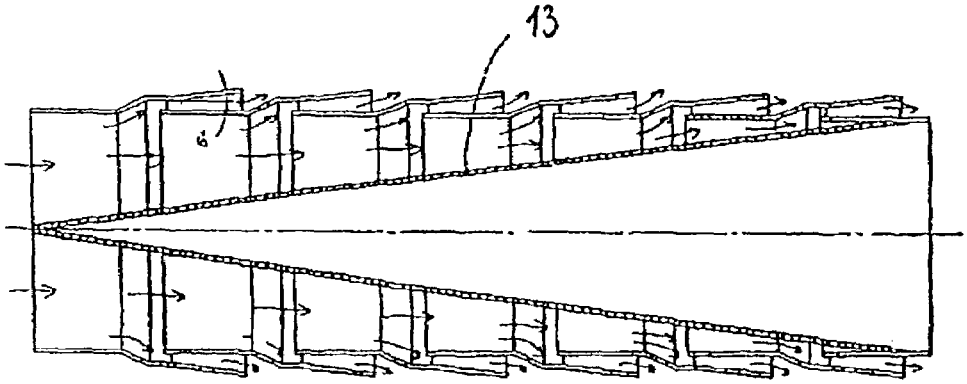
FIG. 4 shows a third embodiment of the invention.

FIG. 4 shows a third embodiment of the invention in which a central cone 13 causes gradual decreasing overall flow area in the axial direction within a flow distributing pipe-like arrangement created by the same identical rotational symmetric members as those shown in FIG. 3. With this arrangement, a more even flow distribution between the individual slots is achieved.

Figure 5:
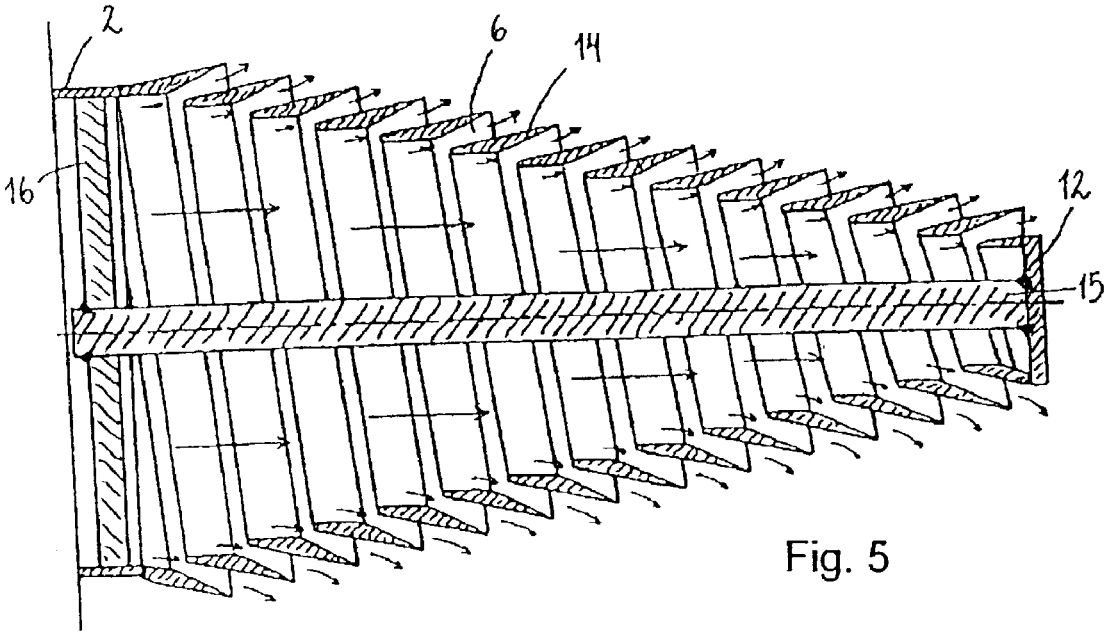
FIG. 5 shows a fourth embodiment of the invention.

FIG. 5 shows a fourth embodiment, where a single narrow aperture is formed by a helically winding slot 6 created between the sides of a single wound helical element 14 formed in an overall conical pipe-like arrangement with a gradually decreasing flow area in the axial pipe-flow direction. At its ends, the helical element is fixed to the inlet pipe 2 and to an end plate 12, respectively. The axial stiffness of the arrangement is secured by a central member 15 which is fixed both to a radial rod 16 and to the plate 12. Alternatively, or as a supplement, axial stiffness may be created by small ribs added to or being a part of the element 14. A further possibility would be to have axial straight members extending along the windings and fastened to all or to some windings by welding and/or pressing such straight members into slots or holes of the windings. Whatever arrangements adopted to increase stiffness, they will typically be of a small transverse dimension to cause minimal flow disturbance.

Both embodiments shown in FIGS. 4 and 5 can be so designed that the axial flow velocity within the pipe-like arrangement remains essentially constant in the flow direction with an exception for the most downstream portion and depending upon how the arrangement is terminated (by a solid wall 12 or otherwise).

The winding helical element 14 shown in FIG. 5 can be made from a long straight metal strip being exposed to both bending and stretching forces when rolled up in, for instance, a lathe on a central supporting member with a conical winding form which corresponds to the winding form of element 14. In this process, pressing tools may be used onto the outside of the element. A second and temporary winding member (not shown) securing the right distance between windings may be rolled up together with element 14 and removed afterwards.

Figure 6:
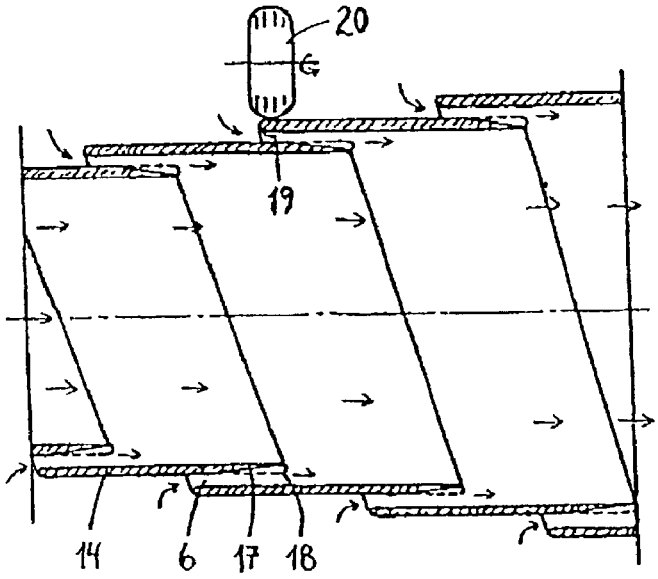
FIG. 6 shows a fifth embodiment of the invention.

FIG. 6 shows part of a fifth embodiment of the invention wherein a wound helical slot 6 constitutes an inflow section to a pipe-like arrangement which can be used to provide internal outflow from a silencer chamber. The main version shown here is made from a sharpened (part 17) metal strip which, when wound up, creates a flow area widening section at aperture outlet between the windings. Alternatively, as a simplification and indicated by punctuated line 18, element 14 may be of constant thickness, in which case the slot has constant area in flow direction. As a further variation, the inflow section of the winding slot may be of smaller cross-section. This can be achieved by pressing an indentation 19 onto the wound element 14 by means of a wheel tool 20. Such smaller inflow area will increase the acoustic resistance of the winding slot while only causing moderate pressure losses if the inflow section has a diffuser form as indicated by a dotted line in the figure.

Figure 7:
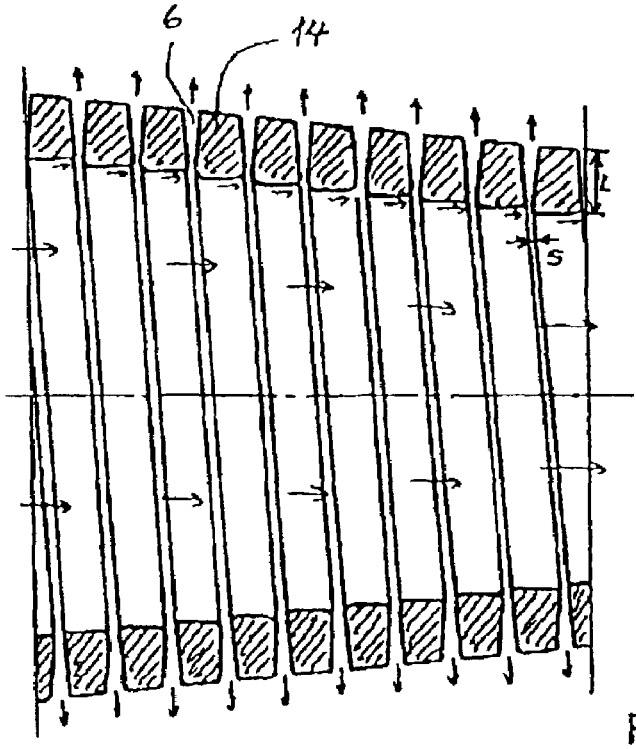
FIG. 7 shows a sixth embodiment of the invention.

FIG. 7 shows part of a sixth embodiment of the invention which resembles the two preceding embodiments in that there is a helically winding element 13. But, whereas in FIGS. 5 and 6 the flow through the apertures is axial, in FIG. 7 it is instead radial. When comparing FIG. 7 with FIG. 2 it can readily be seen that the embodiment shown in FIG. 7 provides an easy way to obtain a flow-friendly big ratio L's. If the slot is kept sufficiently narrow, a reasonable size of this ratio can be achieved, even when the wall thickness of the conical pipe-like element is kept rather small. In the figure, helical element 14 is shown to be massive. Manufacturing it from a hollow closed or outwardly open profile provides further possibilities of restricting weight and material costs.

Figure 8:
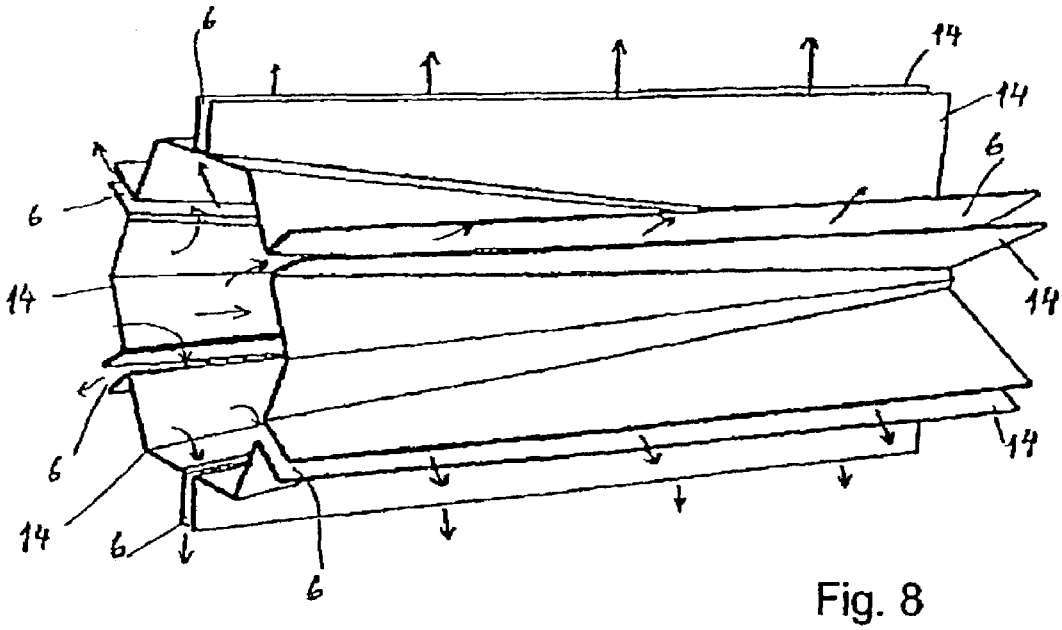
FIG. 8 shows a seventh embodiment of the invention.

FIG. 8 is a perspective view of part of a seventh embodiment of the invention, where radially extending slots 6 are created between identical bent members 14. These members can be fixed to each other, for instance by indentations or ribs extending in the radial direction.

Figure 9:
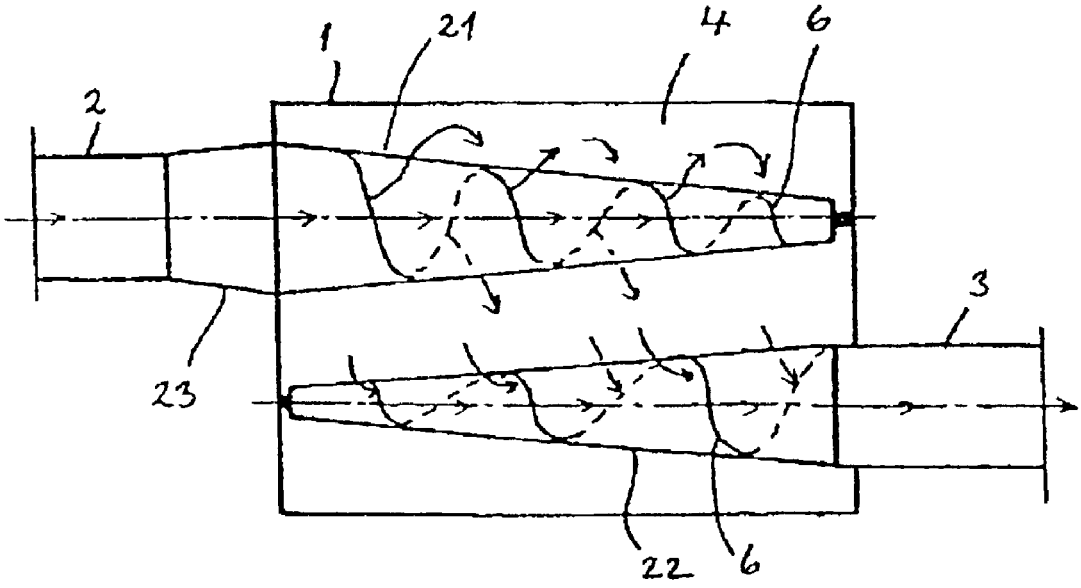
FIG. 9 shows an eighth embodiment of the invention.

FIG. 9 shows an eighth embodiment of the invention in which an inflow element 21 and an outflow element 22 are combined inside a silencer chamber 1 to create a very compact design, where a virtually constant distance is kept between coned members, each provided with helically winding slots 6 to increase pressure recovery. A short axial diffuser 23 has been interposed between inlet pipe 2 and member 21.

Figure 10:
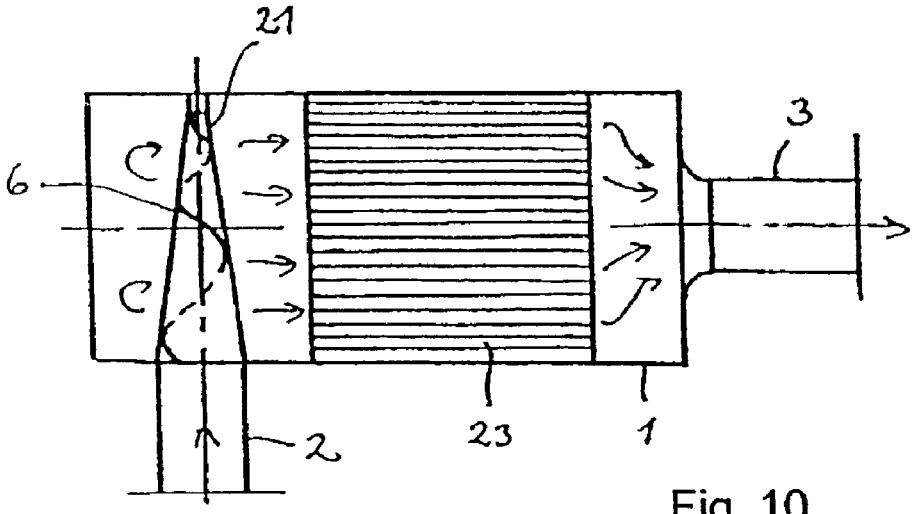
FIG. 10 shows a ninth embodiment of the invention.

Finally, FIG. 10 shows a ninth embodiment of the invention in which an inflow member 21 with a helical slot, which may be formed as a diffuser, distributes flow in front of a monolith 23 placed inside a silencer casing 1.

Inlet pipe 2 has been shown to have an axis of symmetry being perpendicular to the axis of symmetry of the casing. Alternatively, the two axes can be arranged with other angles. Thereby, a very compact apparatus can be accommodated to various outer geometrical conditions concerning external piping arrangements. Monolith 23 can be a particulate trap or a catalytic converter, or it can be made of two or more different types of monoliths.

A further alternative to the embodiment shown in FIG. 10 is a silencer with more chambers in which an inflow member 21 and/or an outflow member according to the invention is/are accommodated in chambers with/without monoliths in various combinations, thereby creating combined silencer/purification units possessing the various advantages demonstrated by previous embodiments of the invention showing silencers not containing monoliths.

In the case of a flow distributing member according to the invention providing outflow from a pipe or passage, it will often be advantageous to size the apertures in such a way that the total minimum flow area for all/the entire aperture(s) does not deviate much from the gross inflow area to the member, and to design the aperture(s) with flow area widening causing pressure recovery inside apertures. As a variation, shown in FIG. 9, there may be diffuser preceding the flow distributing member.

A further possibility may be to create instead an accentuated minimum total flow area at the inlet to apertures. This may in particular be useful when a flow distributing member according to the invention is used at the chamber outflow/pipe inflow, to increase acoustical transmission resistance at the chamber/pipe transition.

In diffuser designs, a classical question is how to size the ratio between outlet and inlet cross-sectional areas. For a given type of diffuser, pressure recovery will gradually increase when this ratio is increased from a low value. Above a certain value of the ratio, flow separation will occur, i.e. the flow is no longer capable of adhering to all walls of the diffuser. In many cases, this is an unwanted situation. When diffusers are used in silencers, flow separation is normally to be avoided, since this phenomenon is associated with regenerated noise. Very big flow area ratios are bad in almost any situation, since major flow separation may destroy pressure recovery.

Yet, in diffuser literature, it is pointed out that a maximum pressure recovery will normally occur at a flow area ratio somewhat in excess of the maximum value at which flow separation is prevented. In flow distributing members according to the invention, this insight may be utilised to allow for a flow area ratio associated with some flow separation to be selected to ensure a great pressure recovery.

The reason is that although increased regenerated noise will accompany pressure recovery, the centre frequency of this noise will be relatively high, since this frequency is linked to the transverse dimensions of the aperture, i.e. to a rather small wavelength. Such predominantly high-frequency, regenerated noise is rather easily attenuated elsewhere in the silencer, for instance in sound absorptive material. In particular, selecting a relatively big flow-area ratio in diffuser-shaped apertures according to the invention can be used at inlets to pipes leading exhaust gas from a silencer chamber, to increase the acoustical entrance resistance (the impedance).

It is foreseen that the invention will be applied both to silencers of complete new designs and to silencer types already used, for instance in currently marketed vehicles. In the latter case, internal silencer pipes with simple perforations (as shown in FIG. 1) may be replaced by improved members with slots of a bigger length, to improve both on pressure losses and on acoustical performance. Silencer manufacturers may find such a partial modification attractive, since investments in design and pressing tools for other parts (the casing, etc.) can thus be kept unchanged, whereby development and manufacturing costs can be kept at a minimum.

In the present invention, the dimension s is at maximum 0.2 times the smallest cross-sectional dimension D of the inlet or outlet to which the flow distributing means is connected. The length L will be at least the same as the dimension s, whereby the apertures are formed so as to provide a flow-area widening in flow direction along at least part of the aperture length L and wherein substantial pressure recovery takes place with the apertures. In the invention, the geometrical surface extends in an axial direction and has a certain axial length. This axial length can be at least twice the smallest cross-sectional dimension D. The walls or profiles are adapted to be through flowed at one or more positions around at least 180 degrees of the periphery of the tube. The dimension s disclosed above can be at 0.1 or 0.5 or at least twice or at least four times the dimensions.

The minimum total flow cross-sectional area of said apertures is a factor f times the cross-sectional area of the inlet or outlet to which said flow distributing means is connected, said factor f being at the most 1.3 and at the least 0.7. The factor f can be between 0.9 and 1.1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A silencer comprising a casing, one or more pipes or passages leading a flow of gas to said casing and means for leading gas from said casing, the silencer further comprising at least one internal chamber, one or more flow inlets to said chamber and one or more flow outlets from said chamber, and one or more flow distributing means connected to at least one of said one or more flow inlet and to said one or more flow outlet, said flow distributing means comprising one or more walls or profiles extending on a geometrical surface defining a boundary between an inner volume of said flow distributing means and said chamber, and one or more apertures for a flow of gas through said apertures and for leading gas either out of said inner volume into said chamber, or into said inner volume from said chamber, said apertures having a smallest cross-sectional transverse dimension s and a length L, said dimension s being at the maximum 0.2 times the smallest cross-sectional dimension D of the inlet or outlet to which the flow distributing means is connected, and said length L being at least the same as said dimension s, whereby said one or more aperture are formed so as to provide a flow-area widening in flow direction along at least part of the aperture length L, and wherein substantial pressure recovery takes place within said one or more aperture.

2. The silencer according to claim 1, wherein said geometrical surface extends in an axial direction and has an axial length which is at least twice said smallest cross-sectional dimension D.

3. The silencer according to claim 1, wherein said geometrical surface extends in an axial direction and has an axial length which is at least four times said smallest cross-sectional dimension D.

4. The silencer according to claim 1, wherein said walls or profiles form a tube across which gas passes through said apertures.

5. The silencer according to claim 4, wherein said walls or profiles are adapted to be through-flowed at one or more positions around at least 180 degrees of the periphery of said tube.

6. The silencer according to claim 1, wherein said dimension s is at the most 0.1 times said dimension D.

7. The silencer according to claim 1, wherein said dimension s is at the most 0.05 times said dimension D.

8. The silencer according to claim 1, wherein said length L is at least twice said dimension s.

9. The silencer according to claim 1, wherein said length L is at least four times said dimension s.

10. The silencer according to claim 1, wherein the inflow to said apertures is provided with flow-separation preventing rounding of contours or is otherwise formed so as to cause gradually decreasing flow cross-section at the inlet to said apertures.

11. The silencer according to claim 1, wherein said flow distributing means are adapted to lead gas to a silencer chamber.

12. The silencer according to claim 1, wherein said flow distributing means are adapted to lead gas from a silencer chamber.

13. The silencer according to claim 1, wherein the minimum total flow cross-sectional area of said apertures is a factor f times the cross-sectional area of the inlet or outlet to which said flow distributing means is connected, said factor f being at the most 1.3 and at the least 0.7.

14. The silencer according to claim 13, wherein said factor f is between 0.9 and 1.1.

15. The silencer according to claim 1, wherein a flow-area narrowing passage part precedes said flow-area widening part when seen in said flow direction.

16. The silencer according to claim 1, wherein said flow-area widening is gradual.

17. The silencer according to claim 15, wherein said flow-area widening is so small that no major flow separation may occur within said one or more aperture.

18. The silencer according to claim 15, wherein flow separation may occur within said one or more aperture.

19. The silencer according to claim 1, wherein said one or more aperture are formed so as to maximise pressure recovery within said one or more aperture.

20. The silencer according to claim 1, wherein the cross-sectional area within said one or more aperture are substantially constant.

21. The silencer according to claim 4, wherein the flow direction within said one or more aperture are substantially transverse to the overall flow direction within said tube.

22. The silencer according to claim 4, wherein the flow direction within said one or more aperture are substantially aligned with the overall flow direction within said tube.

23. The silencer according to claim 1, wherein said apertures are separate holes.

24. The silencer according to claim 1, wherein said apertures comprise at least two slots.

25. The silencer according to claim 24, wherein said apertures are formed between substantially rotational symmetrical tube members.

26. The silencer according to claim 25, wherein said tube members are substantially identical.

27. The silencer according to claim 25, wherein the size of said tube members decreases in the flow direction in case of said flow distributing means being connected to a chamber inlet, and the size of said tube members increases in the flow direction in case of said flow distributing means being connected to a chamber outlet.

28. The silencer according to claim 26, wherein a central conical member is inserted into said flow distributing means.

29. The silencer according to claim 4, wherein said apertures are formed as slots between substantially identical members, each of said members covering an angular segment of said tube.

30. The silencer according to claim 29, wherein the flow direction through said slots is radial.

31. The silencer according to claim 4, wherein a helically winding element forms said tube, and said aperture is formed as a helically winding slot between the windings of said winding element.

32. The silencer according to claim 28, wherein said tube decreases in diameter in the flow direction in case of said tube being connected to a chamber inlet, and said tube increases in diameter in case of said tube being connected to a chamber outlet.

33. The silencer according to claim 3, wherein said tube is terminated by a closed end.

34. The silencer according to claim 3, wherein said tube is terminated by a wall with apertures.

35. The silencer according to claim 3, wherein said tube is terminated by an open end.

36. The silencer according to claim 35, wherein said open end is formed as a diffuser.

37. The silencer according to claim 1 and further comprising means for applying the silencer to the engine system of a vehicle.

38. The silencer according to claim 1, further comprising one or more monoliths being at least one of filters and catalytic converters.

39. The silencer according to claim 38, wherein one or more of said flow distributing members is/are arranged upstream of one or more of said monoliths.

40. A vehicle comprising an engine and a silencer according to claim 1.

41. A method of at least one of reducing the pressure drop across a silencer and improving attenuation conferred by the silencer, the method comprising the step of replacing one or more perforated pipe members in said silencer with one or more flow distributing elements, said flow distributing elements comprising one or more walls or profiles extending on a geometrical surface defining a boundary between an inner volume of said flow distributing elements and a chamber of the silencer, and one or more apertures for a flow of gas and for leading gas either out of said inner volume into said chamber, or into said inner volume from said chamber, said apertures having a smallest cross-sectional transverse dimension s and a length L, said dimension s being at the maximum 0.2 times the smallest cross-sectional dimension D of the inlet or outlet to which the flow distributing means is connected, and said length L being at least the same as said dimension s, whereby said aperture are formed so as to provide a flow-area widening in flow direction along at least part of the aperture length L, and wherein substantial pressure recovery takes place within said one or more aperture.

* * * * *